US012729907B2

(12) United States Patent
Zhang et al.

(10) Patent No.: US 12,729,907 B2
(45) Date of Patent: Sep. 8, 2026

(54) METHOD AND APPARATUS FOR CRYOGENIC AIR SEPARATION

(71) Applicant: L'Air Liquide, Société Anonyme pour l'Etude et l'Exploitation des Procédés Georges Claude, Paris (FR)

(72) Inventors: Yongshun Zhang, Hangzhou (CN); Alain Briglia, Huille-Lezigne (FR); Xianbiao Zheng, Hangzhou (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 427 days.

(21) Appl. No.: 17/946,438

(22) Filed: Sep. 16, 2022

(65) Prior Publication Data

US 2023/0090158 A1 Mar. 23, 2023

(30) Foreign Application Priority Data

Sep. 18, 2021 (CN) ..... 202111098042.X
Aug. 26, 2022 (CN) ..... 202211034694.1

(51) Int. Cl.
*F25J 3/04* (2006.01)

(52) U.S. Cl.
CPC ..... *F25J 3/04406* (2013.01); *F25J 3/04187* (2013.01); *F25J 3/04393* (2013.01);
(Continued)

(58) Field of Classification Search
CPC .. F25J 3/04296; F25J 3/04393; F25J 3/04812; F25J 3/04054; F25J 3/04406; F25J 3/04187; F25J 2200/04; F25J 2210/40; F25J 2215/42; F25J 2215/50; F25J 2240/10; F25J 2290/12; F25J 3/04836; F25J 2210/06; F25J 3/04472; F25J 3/04503; F25J 3/04509; F25J 3/04515; F25J 3/04478; F25J 3/04484; F25J 3/0449; F25J 3/04496
See application file for complete search history.

(56) References Cited

U.S. PATENT DOCUMENTS 5,475,980 A 12/1995 Grenier et al.
2005/0126221 A1 6/2005 Ha et al.
(Continued)

FOREIGN PATENT DOCUMENTS

| | | |
|---|---|---|
| CN | 106 716 033 | 5/2017 |
| DE | 10 2017 010001 | 5/2018 |
| EP | 2 963 369 | 1/2016 |

OTHER PUBLICATIONS

EP Search Report and Written Opinion for EP 22 19 5369, mailed Jan. 27, 2023.

*Primary Examiner* — Joel M Attey
*Assistant Examiner* — Brahim A. Michael Adeniji
(74) *Attorney, Agent, or Firm* — Justin K. Murray

(57) ABSTRACT

The present disclosure provides a method for cryogenic air separation. In the method, part (b2) of the air (b) is compressed in warm booster (7), cooled in heat exchanger (2) and then divided in two, one part (c1) being compressed in a cold booster(9) driven by one turboexpander (11) in which the other part (c2) of air (c) is expanded, and another part of the feed air is not boosted but is expanded in another turboexpander (6) which drives the warm booster (7). The present disclosure also provides an apparatus for cryogenic air separation.

13 Claims, 1 Drawing Sheet

(52) U.S. Cl.
CPC ..... *F25J 2200/04* (2013.01); *F25J 2210/40* (2013.01); *F25J 2215/42* (2013.01); *F25J 2215/50* (2013.01); *F25J 2240/10* (2013.01); *F25J 2290/12* (2013.01)

(56) References Cited

U.S. PATENT DOCUMENTS

| | | | | |
|---|---|---|---|---|
| 2014/0318179 | A1 | 10/2014 | Ha et al. | |
| 2016/0003535 | A1* | 1/2016 | Goloubev | F25J 3/04678 62/643 |
| 2016/0356547 | A1* | 12/2016 | Goloubev | F25J 3/04084 |
| 2017/0234614 | A1 | 8/2017 | Autenschlager et al. | |
| 2018/0347900 | A1* | 12/2018 | Golubev | F25J 3/04351 |
| 2020/0080773 | A1* | 3/2020 | Xu | F25J 3/0409 |
| 2022/0074657 | A1* | 3/2022 | Day | F25J 3/04054 |

* cited by examiner

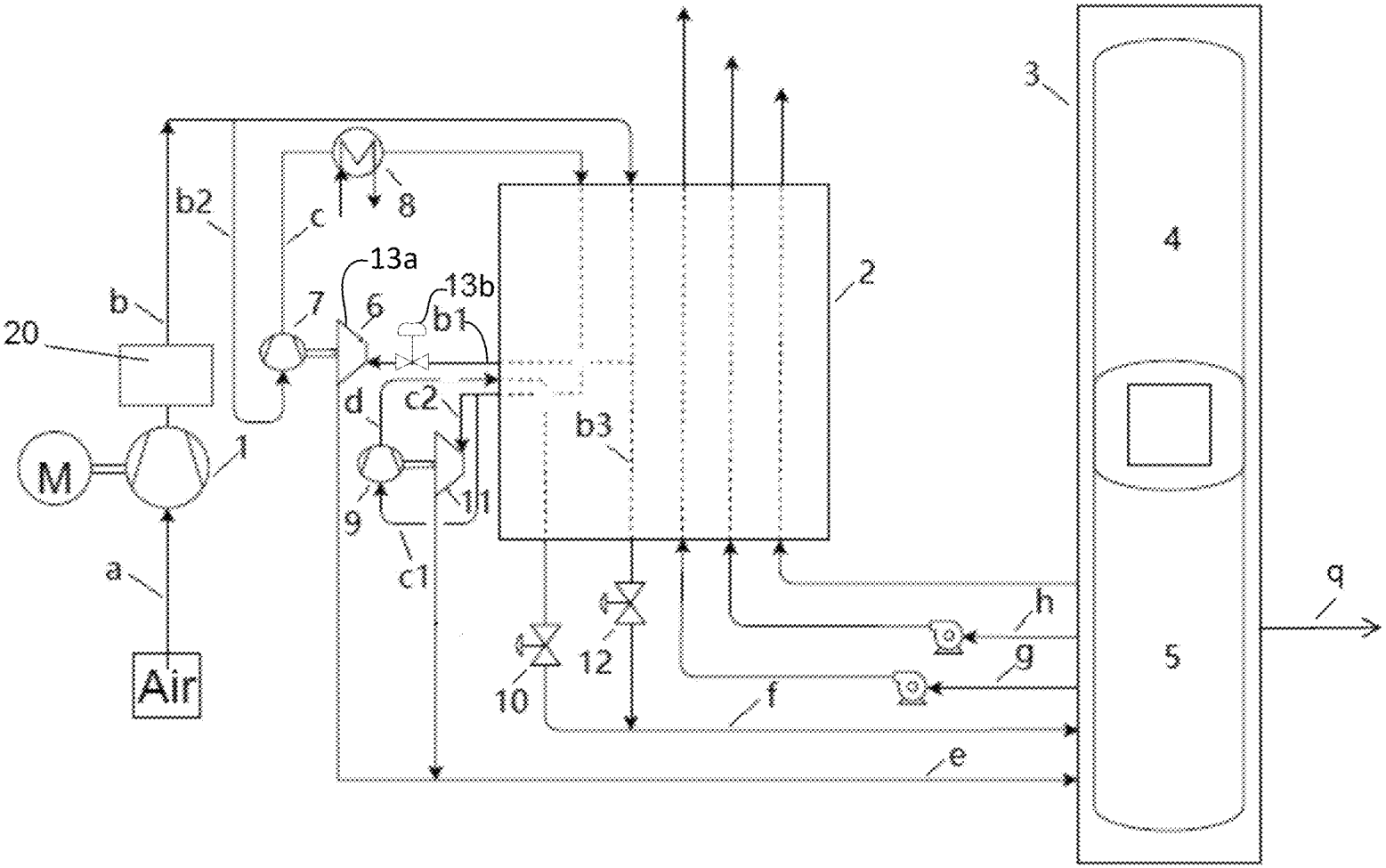
Air
a
b
b1
b2
b3
c
c1
c2
d
e
f
g
h
1
2
3
4
5
6
7
8
9
10
11
12
13a
13b
20
M
q

METHOD AND APPARATUS FOR CRYOGENIC AIR SEPARATION

CROSS REFERENCE TO RELATED APPLICATIONS

This application claims the benefit of priority under 35 U.S.C. § 119 (a) and (b) to Chinese Patent Application No. 202111098042,X, filed Sep. 18, 2021, the entire contents of which are incorporated herein by reference.

TECHNICAL FIELD

The present disclosure relates to the field of air separation, to a method and an apparatus for cryogenic air separation, and in particular to a method and an apparatus for producing liquid or gaseous air output through cryogenic separation.

BACKGROUND ART

An apparatus for cryogenic air separation generally comprises a main air compressor, a main heat exchanger and a rectification column system. As an example, a rectification column system in the form of two columns has a low-pressure column and a high-pressure column operating respectively at a lower pressure and a higher pressure.

Chinese invention patent CN106716033A discloses a method for cryogenic air separation based on high air pressure (HAP) method. In the method, a dense fluid expander is used to expand a third part of the compressed feed air stream, and the third part is fed to the dense fluid expander in a liquid state and at a fourth pressure to reduce the operating costs.

The inventors of the present disclosure consider that, there are various requirements for the cryogenic air separation. For example, sometimes the yield of liquid output is required to be high, and sometimes it is required to be low. Through further analysis, the inventors consider that it is possible to attempt to perform regulation in one apparatus for cryogenic air separation to meet different requirements. However, the prior art such as the existing method mentioned above cannot perform regulation according to actual requirements. For example, it cannot perform regulation to obtain the liquid output at different yields.

In view of the above, it is necessary to design a method and an apparatus for cryogenic air separation, such that the regulation can be performed in one apparatus for cryogenic air separation to meet different requirements.

BRIEF SUMMARY OF THE INVENTION

An object of the present disclosure is to provide a method for cryogenic air separation and an apparatus for cryogenic air separation, in which the regulation can be performed to obtain the liquid output at different yields.

The present disclosure provides a method for cryogenic air separation, wherein air is separated cryogenically in an apparatus for cryogenic air separation comprising a main air compressor, a main heat exchanger, and a rectification column system. The rectification column system has a low-pressure column operating at a first pressure and a high-pressure column operating at a second pressure higher than the first pressure. The method comprises, compressing total feed air in the main air compressor into air of a third pressure, wherein the third pressure is higher than the second pressure; partially cooling a first part of the air of the third pressure in the main heat exchanger, and then expanding the first part from the third pressure in a first turboexpander; further compressing a second part of the air of the third pressure in a first booster into air of a fourth pressure, and firstly cooling the air of the fourth pressure in an aftercooler, and then secondly cooling the air of the fourth pressure in the main heat exchanger; further compressing a first part of the air of the fourth pressure after secondly cooled, into air of a fifth pressure in a second booster, thirdly cooling the air of the fifth pressure in the main heat exchanger, and then expanding the air of the fifth pressure from the fifth pressure in a first expansion device; expanding a second part of the air of the fourth pressure after secondly cooled from the fourth pressure in a second turboexpander; and, feeding all parts of the total feed air to the rectification column system at the first and/or the second pressure, at least some of the total feed air being sent to the high-pressure column, and obtaining a liquid output from the rectification column system.

In one embodiment, the method further comprises, obtaining the liquid output at a first productivity in a first operation mode, and, obtaining the liquid output at a second productivity in a second operation mode, wherein the second productivity is lower than the first productivity, wherein a ratio of a flow rate of the first part of the air of the third pressure directed through the first turboexpander to a flow rate of the total feed air is lower in the second operation mode than in the first operation mode.

In one embodiment, the ratio is at least 0.5% lower in the second operation mode than in the first operation mode.

In one embodiment, the method further comprises, fully cooling a third part of the air of the third pressure in the main heat exchanger, expanding the third part from the third pressure in a second expansion device, and then feeding the third part to the rectification column system at the first and/or the second pressure.

In one embodiment, the second part of the air of the third pressure is fed to the first booster at a temperature of between 0° C. to 50° C.

In one embodiment, the air of the fourth pressure leaves the first booster at a temperature of between 30° C. to 100° C.

In one embodiment, the first part of the air of the fourth pressure is fed to the second booster at a temperature of between −140° C. to −50° C.

In one embodiment, after the first part of the air of the fourth pressure is compressed in the second booster, the air of the fifth pressure is cooled in the main heat exchange from a temperature of between −90° C. to 20° C. to a temperature of between −140° C. to −180° C., and then enters the first expansion device to be expanded.

In one embodiment, the first part of the air of the third pressure is partially cooled in the main heat exchanger to a temperature of between −150° C. to −90° C., expanded in the first turboexpander, and then fed to the rectification column system.

In one embodiment, the second part of the air of the fourth pressure is partially cooled in the main heat exchanger to a temperature of between −150° C. to −90° C., expanded in the second turboexpander, and then fed to the rectification column system. The first pressure may be 1 to 2 bar, the second pressure may be 4 to 6 bar, the third pressure may be 11 to 28 bar, the fourth pressure may be 25 to 39 bar, and/or, the fifth pressure may be 40 to 75 bar.

The present disclosure also provides an apparatus for cryogenic air separation, comprising a main air compressor, a main heat exchanger, and a rectification column system. The rectification column system has a low-pressure column operating at a first pressure and a high-pressure column operating at a second pressure higher than the first pressure. The main air compressor compresses total feed air into air of a third pressure higher than the second pressure. In the apparatus, a first part of the air of the third pressure is partially cooled in the main heat exchanger, and expanded from the third pressure in a first turboexpander. A second part of the air of the third pressure is further compressed in a first booster into air of a fourth pressure. After firstly cooled in an aftercooler, the air of the fourth pressure enters the main heat exchanger to be secondly cooled. A first part of the air of the fourth pressure after secondly cooled is further compressed into air of a fifth pressure in a second booster, thirdly cooled in the main heat exchanger, and expanded from the fifth pressure in a first expansion device. And, a second part of the air of the fourth pressure after secondly cooled is expanded from the fourth pressure in a second turboexpander. In the apparatus, all parts of the total feed air are fed to the rectification column system at the first and/or the second pressure, at least some of the total feed air being sent to the high-pressure column, and a liquid output is obtained from the rectification column system.

In one embodiment, the apparatus further comprises a regulation element configured to regulate a flow rate of the first part of the air of the third pressure directed through the first turboexpander, such that the apparatus switches between a first operation mode and a second operation mode. The liquid output at a first productivity is obtained by the apparatus in the first operation mode, and the liquid output at a second productivity is obtained by the apparatus in the second operation mode. The second productivity is lower than the first productivity, and a ratio of the flow rate of the first part of the air of the third pressure directed through the first turboexpander to a flow rate of the total feed air is lower in the second operation mode than in the first operation mode.

In the method and the apparatus for cryogenic air separation described above, taking the first turboexpander driving the first booster as an example, the expansion work generated by the first turboexpander can be regulated by regulating the flow rate of the stream entering the first turboexpander, thereby varying the compression work transferred to the first booster. When the compression work of the first booster varies, the compression heat removed by the aftercooler varies therewith, i.e., the enthalpy removed by the aftercooler from the system varies. As a result, the refrigeration input to the rectification column system varies, and thus it is possible to meet the requirements for the production of liquid output at different yields, Specifically, when the flow rate of the first turboexpander increases, the refrigeration input to the rectification column system increases, and the yield of liquid output increases.

Conversely, when the flow rate of the first turboexpander decreases, the yield of liquid output decreases. Therefore, the method and the apparatus for cryogenic air separation described above can perform regulation in one apparatus for cryogenic air separation to obtain the liquid output at different yields.

Furthermore, in the method and the apparatus for cryogenic air separation described above, the stream flowing through the first booster is divided downstream into a stream flowing through the second booster and a stream flowing through the second turboexpander, and thus the flow rate of each stream, in particular the stream flowing through the first booster and the stream flowing through the second turboexpander, can be flexibly regulated and varied. For example, when the flow rate of the first turboexpander is increased to increase the expansion work generated by the first turboexpander, it is possible to increase the flow rate of the first booster to receive the increased expansion work, in order to prevent overspeed of the first booster. At this point, the total stream flowing through the second booster and the second turboexpander increases. If the flow rate of the liquid to be vaporised (for example, liquid oxygen to be vaporised) is constant, the matching flow rate through the second booster should also remain constant, and the flow rate through the second turboexpander should increase accordingly. For another example, the flow rate of the second booster can be regulated to match the liquid oxygen to be vaporised at different flow rates, when the flow rate of the first booster remains constant. Therefore, the present disclosure regulates, in particular increases, the total yield of liquid output by regulating the enthalpy drop introduced into the apparatus for cryogenic air separation, and adapts to different requirements for the yields of components in the liquid output through the arrangement of boosters and turboexpanders.

In addition, in the method and the apparatus for cryogenic air separation described above, the second part of air flowing through the main air compressor is successively compressed to a fifth pressure by the first booster and the second booster, such that this part of air can be used in the main heat exchanger to vaporise, for example, liquid oxygen to be vaporised at the identical/similar pressure. This configuration eliminates the need to arrange a recompressor that provides high compression downstream of the main air compressor. At the same time, both the first booster and the second booster are driven by turboexpanders, thereby reducing the energy consumption during operation.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein:

FIG. 1 is a schematic structural diagram of he embodiment provided by the present disclosure.

In the figure: 1—main air compressor; 2—main heat exchanger; 3—rectification column system; 4—low-pressure column; 5—high-pressure column; 6—first turboexpander; 7—first booster; 8—aftercooler; 9—second booster; 10—first expansion device; 11—second turboexpander; 12—second expansion device; a—total feed air; b—air of the third pressure; b1—first part of the air of the third pressure; b2—second part of the air of the third pressure; b3—third part of the air of the third pressure; c—air of the fourth pressure; c1—first part of the air of the fourth pressure; c2—second part of the air of the fourth pressure; d—air of the fifth pressure; e—feed air of the first pressure; f—feed air of the second pressure; g—liquid oxygen to be vaporised; h—liquid nitrogen to be vaporised.

DETAILED DESCRIPTION OF THE PREFERRED EMBODIMENTS

Specific embodiments of the present disclosure are explained in detail below in conjunction with the accompanying drawings. However, it should be understood that the present disclosure is not limited to such an embodiment described below, and the technical concept of the present disclosure can be implemented in combination with other commonly known techniques or functions, or with other techniques identical to those commonly known techniques.

The terms "first" and "second" are only for the purpose of description, do not refer to a specific time sequence, quantity, or importance, and may not be interpreted as indicating or implying relative importance or implicitly indicating a quantity of the described technical features, but only as distinguishing one technical feature from another in this technical solution. Thus, features for which "first" and "second" are defined may explicitly or implicitly include one or more of said feature. In the description of the present disclosure, the meaning of "multiple" is two or more, unless clearly and specifically specified otherwise, Similarly, qualifiers similar to "a" appearing herein do not indicate a definition of quantity, but describe a technical feature that has not appeared in the preceding text. Similarly, unless it is a noun modified by a specific quantitative quantifier, a noun herein shall be regarded as including both the singular and the plural, and the technical solution may include one of the technical feature or a plurality of it. Similarly, modifiers similar to "approximately" and "about" appearing before numerals herein usually include the numeral, and the specific meaning should be understood in light of the context.

It should be understood that, in the present disclosure, "at least one (once)" refers to one (once) or a plurality (several times)". The expression "and/or" is used to describe the associative relationship between associated objects, and indicates that three types of relationship may exist; for example, "A and/or B" can mean three situations, namely that A alone is present, B alone is present, and A and B are both present, wherein A and B may be singular or plural.

As used herein, the term "and/or" includes any and all combinations of one or more of the associated items listed. Unless otherwise indicated, all terms (including technical and scientific terms) used herein have the same meanings as commonly understood by those ordinarily skilled in the art to which this disclosure belongs. It should also be understood that terms, such as those defined in commonly used dictionaries, should be construed to have meanings consistent with their meanings in the context of this description and the related art, and may not be interpreted in an idealised or excessively formal sense, unless expressly indicated herein. Details of well-known functions or constructions may be omitted for brevity and/or clarity.

Here, natural pressure losses are usually not included in the pressure data. The pressure is assessed to be "equal" here if the pressure difference between the corresponding locations is not greater than the natural line loss due to pressure losses in pipes, heat exchangers, coolers, adsorbers, ordinary regulating valves (not throttle valves), etc. For example, a first part of the total feed air experiences pressure losses in the passages of the main heat exchanger; nonetheless, the pressure at which the gas output is discharged downstream of the main heat exchanger and the pressure upstream of the main heat exchanger are equally described here as the "third pressure". Conversely, only when the corresponding pressure difference is higher than the natural line loss, i.e., when pressure is raised in particular via at least one compressor stage or reduced purposefully via at least one throttle valve and/or at least one pressure reducer (turboexpander), will the second pressure of the stream downstream of certain process steps be "lower" or "higher" than the first pressure upstream of those steps.

In order to characterise pressure and temperature, the present disclosure uses the expressions "pressure" and "temperature", which are intended to express that the corresponding pressure and temperature in the corresponding equipment do not need to be a precise pressure or temperature in order to implement the concept of the present disclosure. However, the pressure and temperature typically vary within a certain range, for example, −±1%, 5%, 10%, 20% or even 50% of the mean value. In this case, the corresponding pressures and temperatures may be in disjoint ranges or in overlapping ranges. Specifically, pressures include, for example, unavoidable or expected pressure drops due to, for example, cooling effects, which also applies to temperatures.

A "turboexpander" or "expander", which may be coupled via a shared shaft with other turboexpanders or energy converters such as oil brakes, electric generators or compressors, is fitted for expanding a gaseous or at least partially liquid stream. However, if a compressor is driven by one or more turboexpanders but has no energy supplied externally, for example, from an electric motor, the expression "turbo-driven compressor" or "booster" is used. Preferably, the first turboexpander and the first booster in the present disclosure are mechanically connected in a suitable manner, and the second turboexpander and the second booster are mechanically connected in a suitable manner. "Mechanically connect" is understood in this context to mean that, a fixed or mechanically adjustable rotational speed relationship is achieved between these rotating parts by means of mechanical parts, for example, gears, belts, transmissions, etc. A mechanical connection is usually achieved by means of two or more parts engaged with one another, for example, parts in shaped or frictional engagement, for example, gears or pulleys utilizing belts or other rotationally fixed connection means. The rotationally fixed connection can be realized in particular by means of a shared shaft, on which the corresponding rotary units are mounted fixedly and can each rotate therewith. The rotary units have the same rotational speed in this case. Under ideal conditions, all the work done by a turboexpander is transferred to the corresponding booster that is mechanically connected thereto.

A "compressor" is a device equipped to compress at least one fluid from at least one initial pressure, at which a stream is fed to the compressor, to at least one final pressure, at which the stream is withdrawn from the compressor. A compressor forms a structural unit which however may comprise multiple "compressor stages" in the form of pistons, screws and/or impellers or turbine arrangements (i.e., axial or radial compressor stages). This also applies in particular to the "main air compressor" of an air separation apparatus, which compresses all or the predominant part of the amount of air fed into the apparatus, i.e., the entire feed air stream, referred to herein as the total feed air. In the MAC/BAC method, a certain amount of air compressed in the main air compressor is brought to a higher pressure in a recompressor (air turbocharger), which is usually likewise designed to be multistage. In particular, the corresponding compressor stages are driven by a shared drive, for example, a shared shaft. In addition, a "recompressor" or "air turbocharger" is a compressor that is driven by external energy, not by or at least not only by the expansion of a previously compressed fluid in the air separation apparatus.

A "main heat exchanger" is used to cool the feed air by means of the indirect heat exchange with the reflux from the rectification column system, for example, warm compressed air and one or more cold streams, or a cryogenic liquid air output and one or more warm streams. The main heat exchanger may be formed of a single heat exchanger section or a plurality of heat exchanger sections connected in parallel and/or in series, e.g. of one or more plate heat exchanger blocks, where the main parts of the streams to be cooled or heated, respectively, are cooled or heated respectively.

The main heat exchanger has "passages" designed as fluid channels separated from one another and having heat exchanging surfaces. "Fully cool" means that the stream to be cooled is sent to the main heat exchanger at the hot end and then cooled to the temperature at the cold end of the main heat exchanger; while "partially cool" means being cooled to a temperature between that at the hot end and that at the cold end of the main heat exchanger, i.e., an "intermediate temperature".

An "aftercooler" serves to cool the high temperature air at the outlet of a compressor or a booster to 40° C. or lower. Under certain conditions, an aftercooler can also help to condense large amounts of water vapour and spoiled oil mist into liquid water and oil droplets so that they can be removed. An aftercooler is usually a water-cooling aftercooler, which uses cooling water at a lower temperature and can take a form of a tubular exchanger with the cooling water flowing in the tubes.

A "liquid output" refers to all the output in liquid form produced directly from the rectification column of the air separation apparatus, including, for example, liquid oxygen output, liquid nitrogen output, liquid argon output, etc. The "liquid output" includes a first part of the liquid output directly as a liquid product, referred to herein as the product type liquid. The product type liquid may include, for example, product type liquid oxygen, product type liquid nitrogen, product type liquid argon, etc. The liquid output also includes a second part of the liquid output that will be vaporised in the main heat exchanger and converted to a gas product, referred to herein as the liquid to be vaporised. The liquid to be vaporised may include, for example, liquid oxygen to be vaporised, liquid nitrogen to be vaporised, and liquid argon to be vaporised. Taking FIG. 1 as an example, after the product type liquid q is exported, it can be directly stored in a storage tank in liquid form as a liquid product, for example, for direct sales. Still taking FIG. 1 as an example, the liquid to be vaporised includes liquid oxygen g to be vaporised and liquid nitrogen h to be vaporised that will be vaporised by the main heat exchanger 2 and converted into an oxygen gas product and a nitrogen gas product, respectively. It can be understood that the liquid oxygen output includes product type liquid oxygen and liquid oxygen to be vaporised, and the liquid nitrogen output includes product type liquid nitrogen and liquid nitrogen to be vaporised.

The "productivity" of liquid output refers to the ratio of the number of moles of the liquid output obtained to the number of moles of the corresponding total feed air, for example per unit time, i.e., a term used to characterise the conversion rate of the total feed air to the liquid output by the apparatus for cryogenic air separation. The productivity is shown herein as the mole percentage. The number of moles of the liquid output obtained within unit time may be converted from or characterised by the flow rate of the liquid output, and the number of moles of the total feed air within unit time may be converted from or characterised by the flow rate of the total feed air. For example, the flow rate of the total feed air is shown herein as the nominal volume of the fluid fed or flowing per unit time, for example, in $Nm^3/h$ (nominal cubic meter per hour). The flow rate of the total feed air may also be referred to as the total feed amount of the total feed air. For another example, the flow rate of the liquid output may be shown as the mass of the fluid produced or flowing per unit time, for example, in t/d (ton per day). The flow rate of the liquid output may also be referred to as the yield or production amount of liquid output. It can be understood that, in the case where the total feed amount of the total feed air is constant, different productivities of the liquid output are directly reflected by different yields of liquid output. Therefore, "yield" will be used instead of "productivity" in some places herein to facilitate understanding.

"Cold boosters" and "warm boosters" will be mentioned herein. A "cold booster" means that, the gas is supplied to this booster at a very low temperature, and even if the temperature of the gas is raised after it is compressed by this booster, the raised temperature is still significantly lower than that of the cooling water. In FIG. 1, the second booster 9 is a typical cold booster. The first part of the air of the fourth pressure has been cooled to a very low temperature T before entering the second booster 9. Preferably, the temperature T may be −140° C. to −50° C. For example, the temperature T is approximately −131° C. in both the first operation mode and the second operation mode shown in Table 1 below. That is, the first part of the air of the fourth pressure is fed to the second booster 9 at a temperature of −131° C., and its temperature will be raised, for example, to between −99° C. to 29° C., after the air is compressed by the second booster 9. However, the raised temperature is still below that of the cooling water, and, at this temperature, the first part of the air of the fourth pressure downstream of the second booster cannot be cooled by the aftercooler. It can be seen from the above that, although the temperature of the stream at a very low temperature is raised after the stream is compressed by a cold booster, the raised temperature is still low, and thus the stream through the cold booster cannot be cooled by an aftercooler utilizing water cooling. That is, the compression heat of the compressed stream from the cold booster cannot usually be removed in an aftercooler, but only in the main heat exchanger, thereby inevitably contributing heat to the system. Therefore, the operating power of a turboexpander coupled to a cold booster has no direct effect on variation in the overall refrigeration of the apparatus for cryogenic air separation and the productivity of liquid output. A "warm booster" means that, the temperature of the stream entering this booster is high, for example, above the ambient temperature, and the compressed stream, that is compressed via the warm booster and thus has a raised temperature, has a significantly higher temperature than the cooling water. Therefore, the energy of the compressed stream downstream of a warm booster can be effectively removed in a conventional aftercooler. In FIG. 1, the first booster 7 is a typical warm booster. It can be seen that an aftercooler 8 is arranged downstream of the first booster 7 to cool the stream. Compared with a cold booster, the operating power of a turboexpander coupled to a warm booster can directly determine the compression work delivered to the warm booster, and thus can directly affect the compression heat removed by the aftercooler, located downstream of the warm booster, i.e., the enthalpy taken away by the aftercooler, thereby directly affecting the variation in the overall refrigeration of the entire apparatus for cryogenic air separation and the productivity of liquid output. In addition, a warm booster and a cold booster may also be considered as boosters operating in hot and cold states, respectively.

In the present disclosure, the "first operation mode" is designed for higher productivity of liquid output, and the "second operation mode" is designed for lower productivity of liquid output. The productivity of liquid output in the first operation mode is referred to as the first productivity, and that in the second operation mode is referred to as the second productivity herein. It can be understood that the first operation mode and the second operation mode are two operation states in which the productivity of liquid output is higher or lower, respectively, relative to each other. This does not preclude such situations in methods and apparatuses for cryogenic air separation that: the yield of liquid output may vary discretely among a plurality (no less than two, for example, three, four or five) of values, or the yield of liquid output may vary continuously over a range of values (i.e., among an inexhaustible number of values). For example, in the foregoing case, two operation states with relatively higher and lower yields of liquid output may be selected, and these two operation states can be regarded as the first operation mode and the second operation mode described in the present disclosure. As an example, the first operation mode may correspond to the highest productivity of liquid output obtainable in the entire method or apparatus, while the second operation mode may correspond to the lowest productivity (for example, 0 mol %, i.e., the outputs coming out of the rectification column system are all gas without any liquid) obtainable in the entire method or apparatus. As mentioned previously, the first operation mode and the second operation mode may also both correspond to intermediate productivity of liquid output, between the highest and the lowest productivities, obtainable in the entire method or apparatus, as long as the intermediate yield corresponding to the first operation mode is higher than that corresponding to the second operation mode.

In the method according to the present disclosure, a turboexpander (the first turboexpander 6 in FIG. 1) is used to drive a warm booster (the first booster 7 in FIG. 1). Compared with the first operation mode, in the second operation mode, the turboexpander driving the warm booster operates at a lower power, and thus the warm booster also operates at a lower power. As mentioned previously, the operating power of a turboexpander coupled to a warm booster can directly determine the compression work delivered to the warm booster, and thus can directly affect the compression heat removed by the aftercooler, located downstream of the warm booster. Taking that the flow rate of the total feed air remains constant as an example, in the first operation mode where the productivity (or flow rate, since the flow rate of the total feed air is constant) of liquid output is higher, more air (at a higher flow rate) is directed through the turboexpander, the power of the turboexpander driving the warm booster can be increased, and thus the turboexpander can generate more expansion work. In this way, more compression work is delivered to the warm booster, and more compression heat is removed by the aftercooler, i.e., more enthalpy is removed by the aftercooler, thereby providing more refrigeration to the entire system, which can increase the flow rate (or productivity) of liquid output. That is, the higher the flow rate directed through the turboexpander driving the warm booster, the higher the productivity of liquid output; and vice versa. It can be understood that, in the case that the flow rate of the total feed air may vary, the higher the ratio of the flow rate directed through the turboexpander driving the warm booster to the flow rate of the total feed air, the higher the productivity of liquid output; and vice versa. It can be seen from the above that in the present disclosure, the desired productivity of liquid output can be obtained according to actual needs by varying the ratio of the flow rate of the air through the turboexpander that drives the warm booster to the flow rate of the total feed air. For example, in the case that the productivity of the liquid to be vaporised in the liquid output remains constant, the productivity of the product type liquid in the liquid output can be changed, so as to obtain the liquid product at different productivities or yields. For example, the product type liquid (or liquid product) discharged from the air separation apparatus may be made to have a productivity of 0-4 mol %, preferably 1,2-3 mol %, relative to the total feed air.

About Pressure

The present disclosure provides a method for cryogenic air separation in an apparatus for cryogenic air separation comprising a main air compressor, a main heat exchanger and a rectification column system. The rectification column system has a low-pressure column operating at a first pressure and a high-pressure column operating at a second pressure. The first pressure is preferably 1-2 bar. The second pressure is preferably 4-6 bar, for example, 5 bar. Other pressures used will be described in detail below.

In the method provided by the present disclosure, the total feed air is compressed in the main air compressor to a third pressure higher than the second pressure. For example, the third pressure may be twice the second pressure, or even higher. Due to technical and economic constraints, almost all of the total feed air is compressed to the third pressure, preferably 11-28 bar, for example, 24 bar.

A first part of the air of the third pressure is partially cooled in the main heat exchanger and expanded from the third pressure in a first turboexpander. "Cool" here and hereafter means that the stream concerned before and/or after expansion passes through one passage of the main heat exchanger at least once. A second part of the air of the third pressure is further compressed in a first booster into air of a fourth pressure, which is cooled in an aftercooler before entering the main heat exchanger for continuation of being cooled. Then, the first part of the air of the fourth pressure after cooled is further compressed into air of the fifth pressure in a second booster, which is a typical cold booster, and then cooled in the main heat exchanger and expanded from the fifth pressure in a first expansion device. A second part of the air of the fourth pressure after cooled is expanded from the fourth pressure in a second turboexpander. A third part of the air of the third pressure is fully cooled in the main heat exchanger and expanded from the third pressure in the second expansion device. The above expanded streams are all fed into the rectification column system. As mentioned previously, the first booster is a warm booster, namely one that operates in the hot state, instead of operating as a cold compressor. By contrast, the second booster is a cold booster, namely one that operates in the cold state. In the method provided by the present disclosure, the second part of the air of the third pressure is successively compressed into air of the fifth pressure in the first booster and the second booster, and thus a conventional recompressor is not needed. These recompressors are driven by externally supplied energy, and in the present disclosure, the work used to drive the aforementioned two-stage boosters is mainly obtained from the expansion work of the turboexpanders coupled thereto respectively.

In the present disclosure, through the above-mentioned compression, the air of the fifth pressure with a pressure significantly higher than the second pressure passes through the first expansion device under a supercritical pressure, and is expanded from the fifth pressure, while the third part of the air of the third pressure is expanded from the third pressure by the second expansion device. The flow rates of the air flowing through the first expansion device and the second expansion device correspond to the flow rates of the liquid to be vaporised at different pressures in the air separation apparatus. Among them, the air flowing through the first expansion device has a higher pressure, and needs to correspond to the liquid to be vaporised at a higher pressure. For example, in the illustrated embodiment, the pressure of the liquid oxygen g to be vaporised is higher than the pressure of the liquid nitrogen h to be vaporised, and thus the flow rate of the air flowing through the first expansion device mainly depends on the flow rate of the liquid oxygen g to be vaporised, while the flow rate of the air flowing through the second expansion device mainly depends on the flow rate of the liquid nitrogen h to be vaporised. Preferably, the fourth pressure is 25-39 bar, and the fifth pressure is 40-75 bar. The pressure herein each refers to the absolute pressure.

Finally, all parts of the total feed air, including the first part and/or the second part of the air of the third pressure, are fed into the rectification column system at the first and/or second pressure after the processes described above such as boost and expansion, which also applies to the third part of the air of the third pressure. As mentioned previously, in order to match the flow rate of the liquid oxygen g to be vaporised, the flow rate of the second booster cannot be changed arbitrarily. For example, it is sometimes necessary to maintain an essentially constant flow rate. Therefore, in the present disclosure, a second booster and a second turboexpander are both provided downstream of the first booster for the regulation function, which is different from the prior art. Taking Linde's patent application CN106716033A as an example, in its FIG. 2, after an air stream e is boosted by a recompressor 7 and a first booster, the entire stream e is cooled in an aftercooler and the main heat exchanger before entering into a second booster. Since all of the stream of the first booster flows to the second booster, when the flow rate of the second booster cannot be changed arbitrarily, the first booster can receive an increased expansion work of the first turboexpander 6 only by increasing the pressure ratio, i.e., increasing the rotational speed, which can easily cause the first booster to overspeed (or in other words, reach the upper limit of the pressure ratio) and thus fail, By contrast, in the present disclosure, since the second booster and the second turboexpander are both provided downstream of the first booster (i.e., a part of the stream of the first booster flows to the second booster, while the other part flows to the second turboexpander), as the expansion work of the first turboexpander increases, the flow rate of the first booster can be increased while, for example, the flow rate of the second booster is kept essentially constant, thereby receiving the increased expansion work. In this way, overspeed of the first booster in the hot state can be prevented. In some cases, due to practical needs, for example, customer requirements, the flow rate of liquid oxygen g to be vaporised needs to be changed, and accordingly the stream flowing through the second booster needs to be changed. In the method and the apparatus provided by the present disclosure, since the streams of the second booster and the second turboexpander are both provided by the stream of the first booster, it is possible to vary or regulate the flow rate of the second booster to match the varied flow rate of the liquid oxygen g to be vaporised, while the flow rate through the first booster is maintained to be essentially constant.

In summary, since the streams entering the second turboexpander and the second booster both come from the first booster, the flow rate of each stream can be flexibly regulated and varied to meet different requirements or different conditions.

About Temperature

In order to provide the liquid output of a relatively high productivity, it has been proven particularly advantageous to feed the second part of the air of the third pressure at a temperature of between 0° C. to 50° C., into the first booster to be further compressed into air of a fourth pressure. The air of the fourth pressure leaves the first booster at a temperature of between 30° C. to 100° C. (e.g. 80° C.), and is cooled in an aftercooler, and then enters the main heat exchanger to be further cooled to a temperature T. Preferably, the temperature T is a temperature from −140° C. to −50° C. A first part of the air of the fourth pressure is fed to the second booster at a temperature of between −140° C. to −50° C. This part of air is further compressed in the second booster into air of a fifth pressure, which is cooled in the main heat exchanger from a temperature of between −90° C. to 20° C. to a temperature of between −140° C. to −180° C.

The first part of the air of the third pressure is partially cooled in the main heat exchanger to a temperature of between −150° C. to −90° C. (further, −100° C. to −50° C.), flows through the first turboexpander, and then fed to the rectification column system.

The second part of the air of the fourth pressure is partially cooled in the main heat exchanger to a temperature of between −150° C. to −90° C. (or even to −50° C.), expanded in the second turboexpander, and then fed to the rectification column system.

A schematic structural diagram of the embodiment provided by the present disclosure will be described in detail below with reference to FIG. 1.

FIG. 1 is a schematic structural diagram of the apparatus for cryogenic air separation provided by the present disclosure. As shown in FIG. 1, the total feed air a is fed to the main air compressor 1. The main air compressor 1 is shown in a highly schematic form. The main air compressor 1 typically has a plurality of compressor stages, which may be driven by one or more electric motors via a shared shaft.

Downstream of the main air compressor 1, the compressed total feed air a (all the feed air processed in the air separation apparatus in FIG. 1) enters a precooling and purification unit 20 to remove moisture and carbon dioxide therein. The compressed and purified air b of the third pressure is at a pressure of, for example, 20 bar (as an example of the third pressure). The third pressure in the embodiment shown is significantly higher than the maximum operating pressure of the rectification column system 3, and the pressure difference is, for example, at least 2 or 4 bar, preferably between 6 and 16 bar. In the illustrated two-column process, the highest operating pressure of the rectification column system 3 is the pressure of the high-pressure column 5 operating at the second pressure, preferably 4-6 bar.

The total feed air a is divided into streams b1, b2 and b3. In FIG. 1, the total feed air a is firstly divided into a stream b1 and the other stream upstream of the main heat exchanger 2, and the other stream enters the main heat exchanger 2 and is partially cooled before divided into streams b2 and b3.

In the method provided by the present disclosure, the first part b1 of the air of the third pressure is partially cooled in the main heat exchanger 2 to a temperature of between −156° C. to −90° C., expanded from the third pressure in the first turboexpander 6, and then enters the rectification column system 3. The second part b2 of the air of the third pressure is further compressed in the first booster 7 to a fourth pressure of, for example, 25 bar, and the second part b2 of the air of the third pressure is fed to the first booster 7 at a temperature of between 0° C. to 50° C. The air c of the fourth pressure leaves the first booster 7 at a temperature of between 30° C. to 100° C., and is firstly cooled in the aftercooler band then secondly cooled in the main heat exchanger 2. The third part b3 of the air of the third pressure is fully cooled in the main heat exchanger 2 to a temperature of between −140° C. to −180° C., expanded from the third pressure in the second expansion device 12, and then enters the rectification column system 3. With reference to FIG. 1, the second cooling may be partial cooling (or in other words, incomplete cooling), i.e., the air c of the fourth pressure enters the main heat exchanger 2 from the hot end of the main heat exchanger 2, and then leaves at a position between the hot and cold ends of the main heat exchanger 2.

The first part of the air c1 of the fourth pressure after secondly cooled is fed into the second booster 9 at a temperature of between −140° C. to −50° C. and further compressed to a fifth pressure of, for example, 45 bar. The air d of the fifth pressure is thirdly cooled in the main heat exchanger 2 from a temperature of between −90° C. to 20° C. to a temperature of between −140° C. to −180° C., expanded from the fifth pressure in the first expansion device 10, and then enters the rectification column system 3. With reference to FIG. 1, during the third cooling process, the air d of the fifth pressure may enter the main heat exchanger 2 from a position between the hot and cold ends of the main heat exchanger 2, and then leaves from the cold end of the main heat exchanger 2.

It can be understood that the expansion devices 10 and 12 may be the throttle valves shown in FIG. 1, or other decompressing devices, for example, expanders, in particular liquid expanders.

Compared with a comparative example where a recompressor is arranged downstream of the main air compressor to provide a highly compressed stream, in the method provided by the present disclosure, it is configured such that the second booster 9 is further provided downstream of the first booster 7, which allows the air stream to be easily successively compressed to a pressure that matches that of the liquid to be vaporised and can replace a recompressor. Therefore, the configuration of two boosters arranged in series can reduce capex, energy consumption, and the complexity of the system.

Furthermore, as described previously, the first booster 7 is substantively a warm booster, and the second booster 9 is substantively a cold booster. It is to be noted that, a booster in the cold state can have a higher pressure ratio while receiving the same expansion work, compared with that in the hot state. The arrangement of a cold booster downstream of a warm booster makes it easier to achieve a high degree of compression of the air stream as a whole compared with a comparative example with two warm boosters. Therefore, the present disclosure can, for example, utilize the increased pressure ratio of a cold booster to match a higher pressure of the liquid to be vaporised. To put it another way, for example, the present disclosure can reduce the pressure ratio of the main air compressor in the case that the matched pressure of the liquid to be vaporised remains constant, which can reduce energy consumption. The second part c2 of the air of the fourth pressure after secondly cooled is partially cooled in the main heat exchanger 2 to a temperature of between −150° C. to −90° C., expanded in the second turboexpander 11, and then enters the rectification column system 3.

It should be understood that the use of "firstly cool", "secondly cool" and "thirdly cool" herein is only to characterise the sequence of the corresponding cooling steps, so as to describe the whole method more clearly. This expression does not limit the number of cooling times of the corresponding air. For example, other cooling means or cooling processes may be further provided between two successive cooling steps described herein. However, it can be understood that the process of cooling as shown in the illustrated embodiment is preferred.

It should be understood that, although the first turboexpander 6 and the second turboexpander 11 in FIG. 1 drive the first booster 7 and the second booster 10, respectively, the turboexpanders 6 and 11 may drive the boosters 7 and 10 in the other order. That is, it is sufficient that the two turboexpanders respectively drive or are mechanically connected to the two boosters on a one-to-one basis. In other words, in the preferred embodiment shown in FIG. 1, the first turboexpander 6 drives the first booster 7, and the second turboexpander 11 drives the second booster 9. However, in another embodiment, the first turboexpander 6 may drive the second booster 9, and the second turboexpander 11 may drive the first booster 7. After cooled in the main heat exchanger 2, the air d of the fifth pressure upstream of the expansion devices 10 and 12 is in liquid state at a supercritical pressure, and the third part b3 of the air of the third pressure is also in liquid state. The properties of a supercritical fluid are between gas and liquid.

The rectification column system 3 is shown in a highly simplified form. The rectification column system 3 comprises at least a low-pressure column 4 operating at a pressure of 1-2 bar (designated here as the first pressure) and a high-pressure column 5 operating at a pressure of 4-6 bar (designated here as the second pressure), wherein the low-pressure column 4 and the high-pressure column 5 are thermally coupled via a main condenser. Since it is well known to those skilled in the art, the pipes, valves, pumps, heat exchangers and the like that feed the low-pressure column 4 and the high-pressure column 5 and that connect the main condenser, are not specifically depicted in the figure.

In the illustrated embodiment, streams b1, b2 and b3 are all fed into the high-pressure column 5. However, it is also possible that, for example, the first part b1 of the air of the third pressure and/or the second part c2 of the air of the fourth pressure are fed into the low-pressure column 4 after proper expansion. In one case, the first part b1 of the air of the third pressure and the second part c2 of the air of the fourth pressure are expanded to the first pressure, and then combined to form feed air e of the first pressure to be fed into the low-pressure column 4. The air d of the fifth pressure and the third part b3 of the air of the third pressure are both expanded to the second pressure, and then combined to form feed air f of the second pressure to be fed into the high-pressure column 5.

It should be understood that, after the total feed air a undergoes various processes, the streams at some positions may have already been in the liquid state, gas-liquid mixed state, etc. In consideration of the fact that the various processes here do not change the composition of the corresponding stream, they are sometimes still referred to as air. For example, although the feed air f of the second pressure is referred to as air, the main part thereof is essentially liquid.

As shown in FIG. 1, the apparatus for cryogenic air separation comprises a main air compressor 1, a main heat exchanger 2 and a rectification column system 3. The rectification column system 3 has a low-pressure column 4 operating at a first pressure and a high-pressure column 5 operating at a second pressure. The main air compressor 1 compresses total feed air a into air of a third pressure higher than the second pressure.

The apparatus further comprises a first turboexpander 6, a first booster 7, an aftercooler 8, a second booster 9 and a second turboexpander 11.

A first part of the air of the third pressure is partially cooled in the main heat exchanger 2, and expanded from the third pressure in the first turboexpander 6. A second part of the air of the third pressure is further compressed in the first booster 7 into air of a fourth pressure. The air of the fourth pressure is firstly cooled in the aftercooler 8, and then enters the main heat exchanger 2 to be secondly cooled. The first part of the air of the fourth pressure after secondly cooled is further compressed into air of a fifth pressure in the second booster 9, thirdly cooled in the main heat exchanger 2, and expanded from the fifth pressure in the first expansion device 10. A second part of the air of the fourth pressure after secondly cooled is expanded from the fourth pressure in the second turboexpander 11.

In the illustrated apparatus, all parts of the total feed air a are fed to the rectification column system 3 at the first and/or the second pressure, and the liquid output is obtained from the rectification column system 3.

Through analysis, the inventors considers that the variation in the productivity of the liquid output can be achieved by varying the enthalpy drop caused by the aftercooler 8. For example, as the enthalpy drop caused by the aftercooler 8 gets more, the productivity (yield) of the liquid output gets higher. In particular, in the case that the productivity of the liquid to be vaporised is constant, the productivity of the product type liquid (liquid output) gets higher. As the enthalpy drop caused by the aftercooler 8 gets less, the productivity of the liquid output gets lower. Further, in order to let the aftercooler 8 to cause more enthalpy drop, more expansion work may be provided by providing more stream (at a higher flow rate) through the first turboexpander 6, such that the first booster 7 provides more compression work. However, there is usually an upper limit on the pressure ratio that the first booster 7 can provide, for example, only 1.6 at most in FIG. 1. In order to prevent the first booster 7 from overspeeding in the hot state, or the pressure ratio from reaching the upper limit, in the above method and apparatus provided by the present disclosure, the stream (air c of the fourth pressure) flowing through the first booster 7 may be made to have a higher flow rate.

In the existing method for cryogenic air separation described in the background art, the stream flowing through the second booster has to match the corresponding stream of the liquid to be vaporised, and the same stream flows through the first booster and the second booster. When the yield of liquid to be vaporised is constant, the stream flowing through the first booster cannot be varied. Therefore, when the first turboexpander 6 does more expansion work to achieve a higher yield of liquid output, the first booster 7 can receive the increased expansion work only by increasing the pressure ratio (or, increasing the rotational speed). In this way, the first booster 7 easily overspeeds and thus fails in the hot state, and the productivity of the liquid output cannot be increased. Compared with the existing method for cryogenic air separation described above, the method and apparatus of the present disclosure can realise the variation of the enthalpy drop by regulating the flow rate of the stream flowing through the first booster 7, without overspeed or failure of the first booster 7, thereby easily regulating the productivity of the liquid output.

In addition, in the existing method for cryogenic air separation described in the background art, attempts can be made to obtain a higher productivity of liquid output only by providing a recornpressor between the warm booster and the main air compressor, under the condition that the warm booster has a limited pressure ratio and cannot receive much expansion work. By contrast, in the method and apparatus of the present disclosure, while the flow rate of the second part c2 of the air of the fourth pressure is maintained to match that of the liquid oxygen g to be vaporised, it is easy to receive more expansion work by varying, for example, increasing, the flow rate of the air c of the fourth pressure, thereby increasing the enthalpy drop caused by the aftercooler 8, and thus obtaining a higher productivity of liquid output, for example, in the first operation mode. Therefore, compared with the existing method for cryogenic air separation described above, there is no need to add a recompressor, the capex is lower, and energy consumption is also lower.

In the method for cryogenic air separation, preferably the first booster is coupled to the first turboexpander. Preferably the second booster is coupled to the second turboexpander. Preferably the inlet temperature of the second turboexpander is lower than the inlet temperature of the first turboexpander. Preferably the inlet temperature of the second booster is lower than the inlet temperature of the first turboexpander. Preferably the outlet temperature of the second booster is lower than the inlet temperature of the first turboexpander. Preferabaly the second booster and the second turboexpander have the same inlet temperature. Preferably there is no compression step after the purification step which compresses all the feed air. Thus the air at the third pressure is purified at the third pressure, divided in two at the third pressure and sent in one part directly to the main heat exchanger to be cooled at the third pressure and in another part to the warm booster to be compressed from the third pressure. Preferably the first and/or second turboexpander is a Claude turbine which sends all the expanded air to the high-pressure column.

In the method for cryogenic air separation, part of the air of the third pressure is compressed in warm booster, cooled in a heat exchanger and then divided in two, one part being compressed in a cold booster driven by a Claude turbine in which the other part of air is expanded, and another part of the total feed air is not boosted but is expanded in another Claude turbine which drives the warm booster.

About the First Operation Mode and the Second Operation Mode

In the embodiment shown in FIG. 1, the liquid output obtained from the apparatus for cryogenic air separation is illustrated as including the product type liquid q, the liquid oxygen g to be vaporised and the liquid nitrogen h to be vaporised. It can be understood that, although the product type liquid q is only shown as a single flow path, it may substantively comprise a plurality of flow paths, for example, three flow paths corresponding to the product type liquid oxygen (LOX), product type liquid nitrogen (LIN), and product type liquid argon (LAR). In the method of the present disclosure, the liquid output at a first productivity is obtained in the first operation mode. The liquid output at a second productivity is obtained in the second operation mode. The second productivity is lower than the first productivity. The ratio r1 of the flow rate of the first part b1 of the air of the third pressure directed through the first turboexpander 6 to the flow rate of the total feed air a is lower in the second operation mode than in the first operation mode. Preferably, the ratio r1 is at least 0.5% lower in the second operation mode than in the first operation mode. That is, the difference between the ratios r1 in the two operation modes is no less than 0.5%, more preferably, no less than 1.5%. In the first operation mode with a higher productivity of liquid output, the ratio r1 may, for example, be up to 90%. For example, the ratio r1 may be regulated directly by regulating the flow rate of the first part b1 of the air of the third pressure directed through the first turboexpander 6, in the case that the flow rate of the total feed air a remains constant.

The apparatus may comprise means for switch between the first operation mode and the second operation mode. This means may be, for example, a regulation element 13. The regulation element 13 is configured to regulate the ratio r1 of the flow rate of the first part b1 of the air of the third pressure directed through the first turboexpander 6 to the flow rate of the total feed air a, such that the apparatus switches between the first operation mode and the second operation mode. Preferably, the regulation element 13 can regulate the ratio r1 directly by regulating the flow rate of the first part b1 of the air of the third pressure directed through the first turboexpander 6, for example, in the case that the flow rate of the total feed air a remains constant.

The liquid output at a first productivity is obtained by the apparatus in the first operation mode. The liquid output at a second productivity is obtained by the apparatus in the second operation mode. Among them, the second productivity is lower than the first productivity. In FIG. 1, the regulation element 13 is the first turboexpander 6 itself, which may be referred to as regulation element 13*a*. i.e., the flow rate of the first turboexpander 6 can be directly regulated by operating the first turboexpander 6. In another embodiment, the regulation element 13 can be, for example, a regulating valve, which may be referred to as regulation element 13b, which is provided in a suitable flow path, for example, a flow path between the main heat exchanger 2 and the first turboexpander 6.

It is mentioned before that the flow rate of each stream such as c and c1 can be regulated. The aforementioned means for mode switch may also include other regulation elements. Other regulation elements include, for example, a regulating valve for regulating the flow rate of the air c of the fourth pressure, and, for example, a regulating valve for regulating the flow rate of the first part c1 of the air of the fourth pressure. As an example, the flow rate of the air c of the fourth pressure or the first part c1 of the air of the fourth pressure is regulated by regulating the second turboexpander 11. As another example, the boosters 7 and 9 themselves may be regulated to regulate the flow rate therethrough.

In one embodiment, the aforementioned means for mode switch may also involve complex control devices such as a computer. The control devices and the regulation elements may, for example, enable at least partially automatic switch between the operation modes in combined action. For example, the control devices and the regulation elements may form a properly programmed operation control system.

The parameters of the first operation mode and the second operation mode as an example are listed in Table 1 below.

The data in Table 1 is directed to the method and the apparatus shown in FIG. 1. Specifically, the yield of oxygen from the apparatus is 1,600 t/d.

It is to be noted that, as an example, in the instance provided in Table 1, the flow rate of the total feed air a (i.e., the total feed amount) is essentially constant in the first operation mode and the second operation mode. Since the flow rate of the third part b3 of the air of the third pressure slightly varies in the two operation modes, the sum, of the flow rate of the first booster 7 (i.e., the flow rate of the second part b2 of the air of the third pressure) and the flow rate of the first turboexpander 6 (i.e., the flow rate of the first part b1 of the air of the third pressure) in Table 1, also varies slightly.

It is also to be noted that, in the instance provided in Table 1, in the first operation mode and the second operation mode, the productivity (yield) of liquid to be vaporised (including the liquid oxygen g to be vaporised and the liquid nitrogen h to be vaporised) is also essentially constant. Therefore, the variation in the productivity of the liquid output is mainly reflected by the variation in the productivity of the product type liquid q. Since the flow rate of the total feed air a is constant, the variation in the ratio r1 of the flow rate of the first part b1 of the air of the third pressure directed through the first turboexpander 6 to the flow rate of the total feed air a is substantively reflected directly by the variation in the flow rate of the first turboexpander 6.

In the instance provided by Table 1, the productivity of the liquid product is 2.6% in the first operation mode. In the first operation mode, the flow rate of the first part b1 of the air of the third pressure directed through the first turboexpander 6 is 104,900 $Nm^3/h$, and the power of the first turboexpander 6 is about 1,172 kW. The productivity of the liquid product is 1.2% in the second operation mode. In the second operation mode, the flow rate of the first part b1 of the air of the third pressure directed through the first turboexpander 6 is lower than that in the first operation mode, and the first turboexpander 6 is operating at a lower power. At this point, the flow rate of the first turboexpander 6 is 99,000 $Nm^3/h$, and the power of the first turboexpander 6 is about 1.131 kW.

Compared with the second operation mode, in the first operation mode, more air (at a higher flow rate) is used to pass through the first turboexpander, such that the first turboexpander generates more expansion work, and thus more compression work is transferred to the first booster. In this way, more compression heat is removed and more enthalpy is taken away by the aftercooler, which is equivalent to providing more refrigeration to the entire system, and therefore the productivity of liquid output is higher. Taking the instance provided in Table 1 as an example, the total enthalpy drop in the first operation mode is 1,008,159 Kcal/h, while the total enthalpy drop in the second operation mode is 972,719 Kcal/h. Therefore, the first operation mode

TABLE 1

| | Productivity of the liquid product (mol %) | Enthalpy \| Aftercooler inlet (Kcal/$Nm^3$) | Enthalpy \| Aftercooler outlet (Kcal/$Nm^3$) | Flow rate in the first booster ($Nm^3/h$) | Flow rate in the first turboexpander ($Nm^3/h$) | Power of the first turboexpander (kW) | Enthalpy drop (Kcal/h) |
|---|---|---|---|---|---|---|---|
| First operation mode | 2.6% | 141.3 | 133.0 | 87000 | 104900 | 1172 | 1008159 |
| Second operation mode | 1.2% | 140.4 | 133.0 | 89700 | 99000 | 1131 | 972719 |

can produce more liquid output. Thus, in the case that the liquid to be vaporised remains constant, there would be more liquid product (product type liquid). Therefore, the above method and apparatus are particularly suitable for producing higher yield of liquid output.

In the above method and apparatus, as described previously, the stream cooled by the aftercooler 8 after boosted by the first booster 7 not only flows to the first booster 9 downstream, but also to the second booster 11 downstream. That is, the air c of the fourth pressure is divided into a first part c1 of the air of the fourth pressure and a second part c2 of the air of the fourth pressure. Therefore, compared with the comparative example in which the air c of the fourth pressure only flows to the first part c1 of the air of the fourth pressure, the present disclosure can always keep the flow rate of the corresponding stream (the first part c1 of the air of the fourth pressure) to match the liquid oxygen g to be vaporised, and at the same time significantly increase the flow rate of the stream (the air c of the fourth pressure) flowing through the first booster 7. In this way, the problem of overspeed of the first booster 7 is less prone to occur when the flow rate of the stream (the first part b1 of the air of the third pressure) flowing through the first turboexpander 6 is regulated, in particular increased. Therefore, by regulating the flow rate of the first turboexpander 6, it is possible to easily regulate the productivity or yield of liquid output, especially the liquid product, so that the apparatus can switch between the first operation mode and the second operation mode where the productivities of liquid output are different.

Unless clearly indicated otherwise, each aspect or embodiment defined here can be combined with any other aspect(s) or embodiment(s). In particular, any preferred or advantageous feature indicated can be combined with any other preferred or advantageous feature indicated.

The embodiments in this specification are only preferred specific embodiments of the present disclosure. The above embodiments are only used to illustrate the technical solution of the present disclosure but not to limit the present disclosure. All technical solutions obtainable by those skilled in the art according to the concept of the present disclosure by logical analysis, reasoning or limited experiment should be included in the scope of the present disclosure.

What is claimed is:

1. A method for cryogenic air separation, wherein air is separated cryogenically in an apparatus for cryogenic air separation comprising a main air compressor, a main heat exchanger, and a rectification column system which has a low-pressure column operating at a first pressure and a high-pressure column operating at a second pressure higher than the first pressure, the method comprising the steps of:

compressing a total feed air stream in the main air compressor into a third pressure air stream of a third pressure, wherein the third pressure is higher than the second pressure, partially cooling a first part of the third pressure air stream in the main heat exchanger, thereby producing a cooled third pressure air stream, and then expanding the cooled third pressure air stream in a first turboexpander to form a first air stream, further compressing a second part of the third pressure air stream in a first booster into a fourth pressure air stream of a fourth pressure, and firstly cooling the fourth pressure air stream in an aftercooler, and then secondly cooling the fourth pressure air stream in the main heat exchanger, thereby producing a cooled fourth pressure air stream, further compressing a first part of the cooled fourth pressure air stream after secondly cooled, into a fifth pressure air stream of a fifth pressure in a second booster, thirdly cooling the fifth pressure air stream in the main heat exchanger, and then expanding the fifth pressure air stream from the fifth pressure in a first expansion device to form a second air stream, expanding a second part of the cooled fourth pressure air stream after secondly cooled from the fourth pressure in a second turboexpander to form a third air stream, and feeding the first air stream, the second air stream, and the third air stream to the rectification column system, wherein at least a portion of the first air stream, the second air stream, and/or the third air stream is sent to the high-pressure column; and obtaining a liquid output from the rectification column system, wherein the first booster is mechanically coupled to the first turboexpander, and the second booster is mechanically coupled to the second turboexpander.

2. The method according to claim 1, further comprising:

obtaining the liquid output at a first productivity in a first operation mode, and obtaining the liquid output at a second productivity in a second operation mode, wherein the second productivity is lower than the first productivity, wherein a ratio of a flow rate of the first part of the third pressure air stream directed through the first turboexpander to a flow rate of the total feed air stream is lower in the second operation mode than in the first operation mode.

3. The method according to claim 2, wherein the ratio is at least 0.5% lower in the second operation mode than in the first operation mode.

4. The method according to claim 1, further comprising:

fully cooling a third part of the third pressure air stream in the main heat exchanger, expanding the third part of the third pressure air stream from the third pressure in a second expansion device, and then feeding the third part of the third pressure air stream to the rectification column system.

5. The method according to claim 1, wherein the second part of the third pressure air stream is fed to the first booster at a temperature of between 0° C. to 50° C.

6. The method according to claim 5, wherein the fourth pressure air stream leaves the first booster at a temperature of between 30° C. to 100° C.

7. The method according to claim 6, wherein the first part of the fourth pressure air stream is fed to the second booster at a temperature of between −140° C. to −50° C.

8. The method according to claim 7, wherein after the first part of the fourth pressure air stream is compressed in the second booster, the fifth pressure air stream is cooled in the main heat exchanger from a temperature of between −90° C. to 20° C. to a temperature of between −140° C. to −180° C., and then enters the first expansion device to be expanded.

9. The method according to claim 1, wherein the first part of the third pressure air stream is partially cooled in the main heat exchanger to a temperature of between −150° C. to −90° C., expanded in the first turboexpander, and then fed to the rectification column system.

10. The method according to claim 1, wherein the second part of the fourth pressure air stream is partially cooled in the main heat exchanger to a temperature of between −150° C. to −90° C., expanded in the second turboexpander, and then fed to the rectification column system.

11. The method according to claim 1, wherein the first pressure is 1 to 2 bar, the second pressure is 4 to 6 bar, the third pressure is 11 to 28 bar, the fourth pressure is 25 to 39 bar, and/or, the fifth pressure is 40 to 75 bar.

12. An apparatus for cryogenic air separation, comprising a main air compressor, a main heat exchanger, and a rectification column system which has a low-pressure column operating at a first pressure and a high-pressure column operating at a second pressure higher than the first pressure, wherein the main air compressor compresses a total feed air stream into a third pressure air stream to a third pressure higher than the second pressure, comprising:

a first turboexpander, configured such that a first part of the third pressure air stream is partially cooled in the main heat exchanger, and expanded from the third pressure in the first turboexpander to form a first air stream;

a first booster, configured such that a second part of the third pressure air stream is further compressed in the first booster into a fourth pressure air stream;

an aftercooler, configured such that after firstly cooled in the aftercooler, the fourth pressure air stream enters the main heat exchanger to be secondly cooled;

a second booster, configured such that a first part of the fourth pressure air stream after secondly cooled is further compressed into a fifth pressure air stream in the second booster, wherein the fifth pressure air stream is then thirdly cooled in the main heat exchanger, and expanded from the fifth pressure in a first expansion device to form a second air stream; and a second turboexpander, configured such that a second part the fourth pressure air stream after secondly cooled is expanded from the fourth pressure in the second turboexpander to form a third air stream;

wherein the apparatus is configured such that, the first air stream, the second air stream, and the third air stream are sent to the rectification column system, wherein at least a portion of the first air stream, the second air stream, and/or the third air stream is sent to the high-pressure column, and a liquid output is obtained from the rectification column system, wherein the first booster is mechanically coupled to the first turboexpander, and the second booster is mechanically coupled to the second turboexpander.

13. The apparatus according to claim 12, further comprising:

a regulation element, configured to regulate a flow rate of the first part of the third pressure air stream directed through the first turboexpander, such that the apparatus switches between a first operation mode and a second operation mode;

wherein, the liquid output at a first productivity is obtained by the apparatus in the first operation mode, the liquid output at a second productivity is obtained by the apparatus in the second operation mode, wherein the second productivity is lower than the first productivity, and a ratio of the flow rate of the first part of the third pressure air stream directed through the first turboexpander to a flow rate of the total feed air stream is lower in the second operation mode than in the first operation mode.

* * * * *